United States Patent [19]

Puckett

[11] 4,175,625

[45] Nov. 27, 1979

[54] ARTICULATING GRADER HAVING STRUCTURE FOR RAISING AND LOWERING MOLD BOARD WITHOUT DISTURBING SETTING

[76] Inventor: Robert O. Puckett, 2814 Scenic Hwy., Snellville, Ga. 30278

[21] Appl. No.: 809,447

[22] Filed: Jun. 23, 1977

[51] Int. Cl.[2] ..... E02F 3/76

[52] U.S. Cl. ..... 172/791; 172/797

[58] Field of Search ..... 172/4.5, 780, 781, 789, 172/791, 792, 793, 795, 796, 797

[56] References Cited

U.S. PATENT DOCUMENTS

| | | | |
|---|---|---|---|
| 2,074,081 | 3/1937 | Burns | 172/793 |
| 3,610,341 | 10/1971 | Swisher, Jr. et al. | 172/4.5 |
| 3,677,350 | 7/1972 | Johnson et al. | 172/789 |
| 3,716,105 | 2/1973 | Hallam | 172/780 |
| 3,924,689 | 12/1975 | Manor | 172/780 |

*Primary Examiner*—Richard T. Stouffer

*Attorney, Agent, or Firm*—Patrick F. Henry

[57] ABSTRACT

An articulating grader comprises a rear driver section which has an engine and hydraulic pump arrangement for driving a pair of wheels on each side. A chassis frame includes lower frame members for supporting a mold board assembly which is controlled and set in angularity and vertical movement but supported from a frame support member on the top by a hydraulic piston and cylinder and guide member arrangement, whereby after adjustment the mold board may be moved upwardly vertically and again moved back down to original position without disturbing the setting. A front articulating frame supports steerable wheels controlled by hydraulic power steering.

12 Claims, 5 Drawing Figures

ARTICULATING GRADER HAVING STRUCTURE FOR RAISING AND LOWERING MOLD BOARD WITHOUT DISTURBING SETTING

BACKGROUND OF THE INVENTION

1. Field of the Invention

Grading machines including so-called road graders having articulated frames and adjustable mold board structures including means for setting the mold board.

2. Description of the Prior Art

The prior art includes many articulating road graders having mold board structures thereon. One problem with these prior art devices is that once the mold board is set as to angularity, vertical height and angle of the face if it becomes necessary to lift the mold board to clear an obstruction then it is necessary to find and reset the mold board in its original position in order to continue that particular contour of grading. According to the present invention it is possible to lift the preset mold board structure without disturbing the setting and to return the mold board structure and mold board to the previous setting simply by lowering same.

SUMMARY OF THE INVENTION

A grading machine is provided with a transverse mold board structure which is supported for fixed movement but provided with means for adjusting the mold board in several ways such as to angularity from one end to the other, height above the grade level and even angularity of the face of the mold board. A means is provided whereby the mold board is supported for the usual upward and downward movement but whereby without disturbing the setting the mold board may be moved upwardly and then later returned downwardly to its original position without disturbing the original setting.

In one form of the invention the mold board structure is supported on a transverse frame member which is guided by vertical guide means. A hydraulic piston and cylinder arrangement is connected to the transverse member to drive same upwardly or downwardly carrying the mold board structure without disturbing the setting.

In a more specific form of the invention mentioned in the preceding paragraph the mold board is supported by a pair of hydraulic cylinders, one on each end of the transverse member which are attached by means of U-shaped brackets and pins to a support frame on the mold board.

An object of this invention is to provide a way of raising and lowering a mold board without disturbing the prior setting thereof.

Other and further objects and advantages of this invention will become apparent upon reading the following specification taken in conjunction with the accompanying drawings.

BRIEF DESCRIPTION OF A PREFERRED EMBODIMENT

Figure 1:
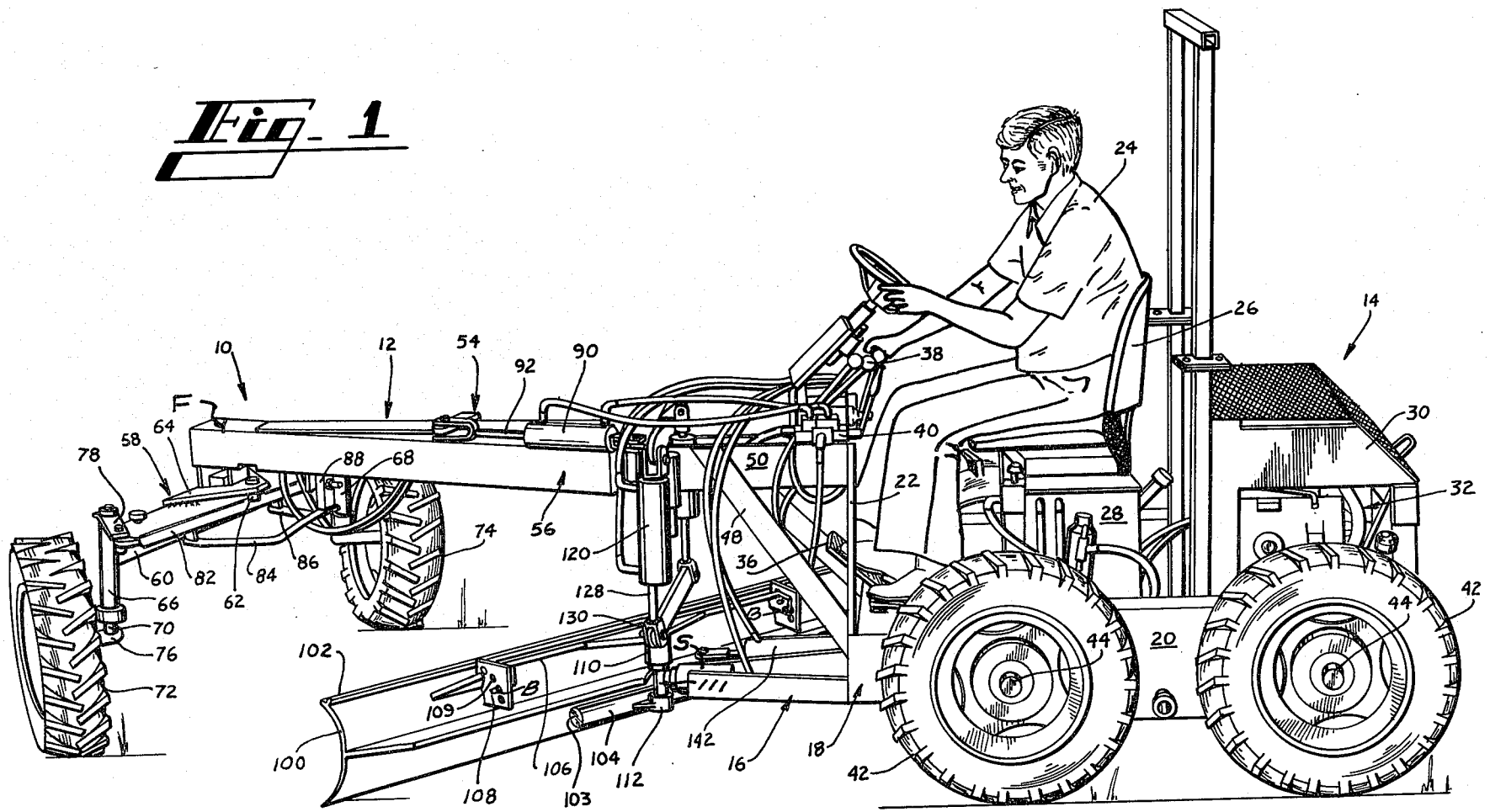
FIG. 1 is a perspective view of the present machine making the turn with the mold board in downward position.
Figure 2:
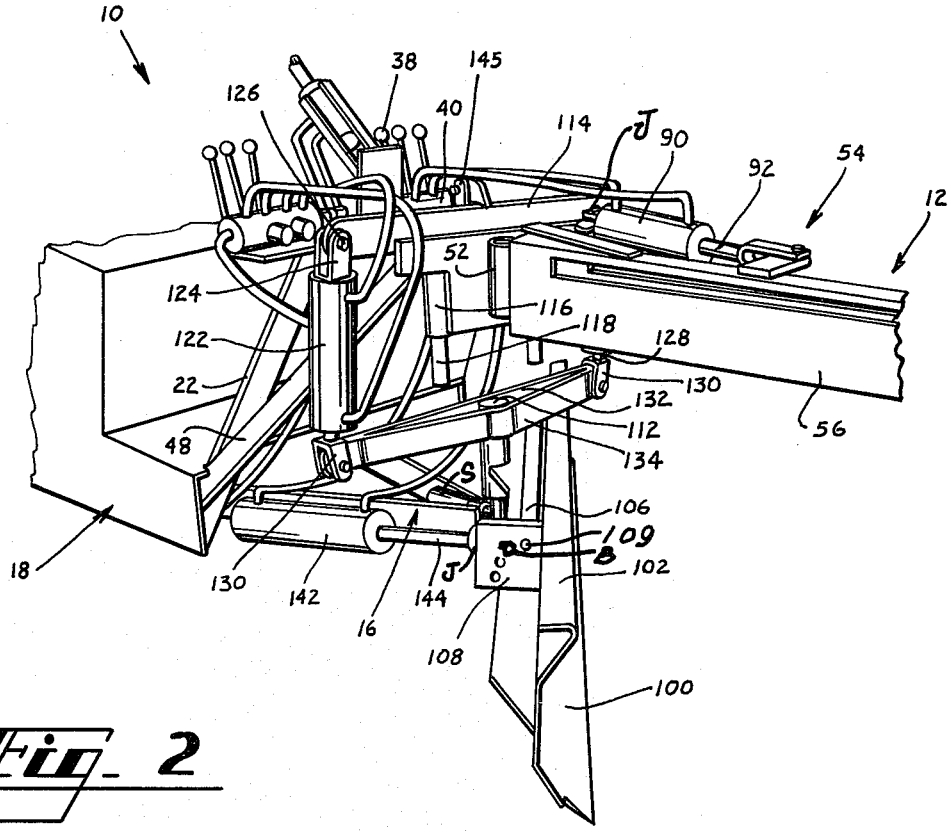
FIG. 2 is a perspective view looking from one side of the front toward the rear and showing the mold board support.

The machine 10 comprises an elongated frame F having a front articulated portion 12 and a rear drive portion 14 comprising a lower frame or chassis 16 pivoted by pivot P in a longitudinal chassis frame 18 including frame members 19 having side plates 20 welded thereto and vertical plates 22 weleded together to define a driver's location for an operator 24 who sits on a driver seat 26 mounted on top of a box 28 made of welded plates and the like. Another box 30 behind the operator 24 is made from welded metal plate and provides a housing for the pump and engine arrangement 32 which is connected by various hydraulic hoses 34 to foot control devices 36 and hand control devices 38 which operate valves 40 of various conventional and well known types.

The frame F is supported by a pair of identical rubber tired wheels 42 on each side of the machine 10 on respective stub axles 44 which are connected to respective hydraulic motors and transmission units powered by the pump and engine arrangement 32.

Chassis members 18 together with vertical plates 22 and diagonal members 48 support a top frame 50 which is a heavy beam frame made from steel plate and the like on which is mounted vertical pivot means 52 and horizontal pivot means 54 providing an articulated connection to a front frame assembly 56 constructed from heavy steel plate and beams to support a front wheel assembly 58 comprising a transverse front steel support tube 60 which is mounted about a longitudinal front pivot pin 62 mounted in a pair of spaced plates 64 welded to the front of the front frame assembly 56. A pair of vertical sleeve bearings 66, 68 support the vertical king pins 70 each having one end connected to a wheel 74, 72 by means of a respective connecting rod 76 and the other end connected to a respective drag link 78, 80 each having one end thereof connected by a common connecting rod 8 which is stabilized by a pair of stabilizing members 84, 86 to a vertical tube 88 welded to and extending from the bottom of the frame assembly 56. A hydraulic cylinder 90 having a piston rod 92 connected to the right hand drag link 78 is controlled to move the king pin on that side to provide the steering of the two front wheels 72, 74.

A conventional mold board assembly 100 comprises a conventional curved mold board 102 having a bottom pivot shaft 103 mounted in a pivot sleeve 104. Board 102 is supported and braced by means of a longitudinal first brace plate 106 welded to the board 102. Plate 106 has enlarged or flattened ends 107 with a hole therein located next to respective attaching plates 108 welded to the board 102 and each plate 108 has several adjustment holes 109 to receive a bolt B inserted in a selected hole 109 and ends 107. Thus, the board 102 may be adjusted about the pivot shaft 103 by removing the bolts from plates 108 and manually rotating same about shaft 103 to another hole 109 in which the bolt B is inserted to lock the board 102 in fixed position on shaft 103.

A vertical sleeve 110 substantially medially of the mold board 102 is welded to the plate 106 and is supported on a rigid T connector 111 having a horizontal cylindrical leg member 111 A inserted and retained for movement in a sleeve S which is attached to the front frame chassis member 18 so that the mold board 102 may be turned substantially about the leg 111 A. There is also a vertical cylindrical leg member 111 B on connector 111 which leg 111 B is inserted and retained (by lock nut or otherwise) on and in sleeve 110 to permit rotation thereabout so that the mold board 102 can rotate. The bottom end of the leg member 111 B is supported in a cylindrical bearing member 112 which is attached to the sleeve 104 whereby the mold board 102 will turn and rotate about the axis of member 111 B to be controlled by the operator in more or less conventional fashion as will appear later. A transverse frame member 114 across the top of the top frame 50 is supported by means of a pair of vertical steel pins 116 mounted in vertical sleeve and bearings 118 which have the sides thereof welded to the sides of the top frame 50.

First and second hydraulic cylinders 120, 122 on opposite ends of the frame member 114 are connected by U-shaped clevis members 124 and pins 126 to frame member 114 and have the respective rods 128 thereof connected by clevis and pin arrangements 130 to the ends of intersecting frame members 132, 134 which are attached to the vertical sleeve 110 on the mold board 102 to adjust and set the board 102 transversely with respect to the ground thereby, for example, making one end of board 102 higher or lower than the other to provide angularity.

A hydraulic cylinder arrangement 142 has cylinder rod 144 thereof connected to the mold board 102 by means of any articulated joint J such as those produced by Special Products Company under the trademark "SPEECO" whereby there is a limited amount of articulated motion at each connection rather than a rigid attachment. This permits the passage beyond the critical point of motion and prevents binding and the like.

Figure 3:
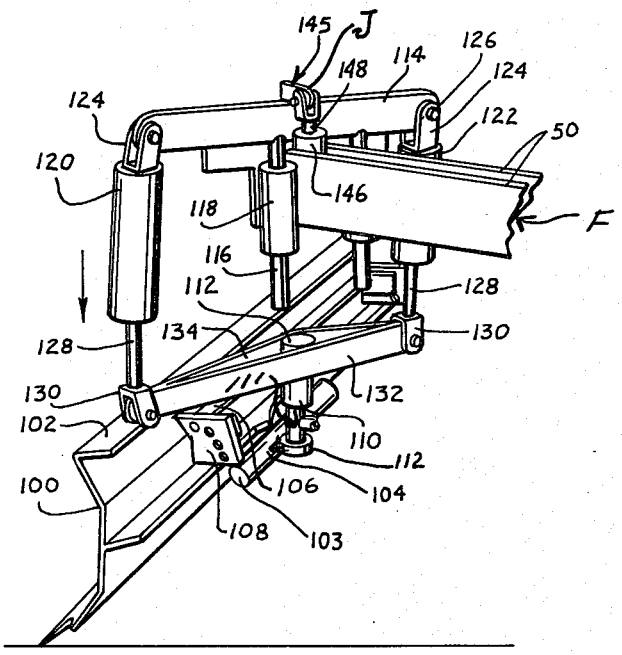
FIG. 3 is a perspective view of the mold board support structure with a mold board in downward grading position.
Figure 4:
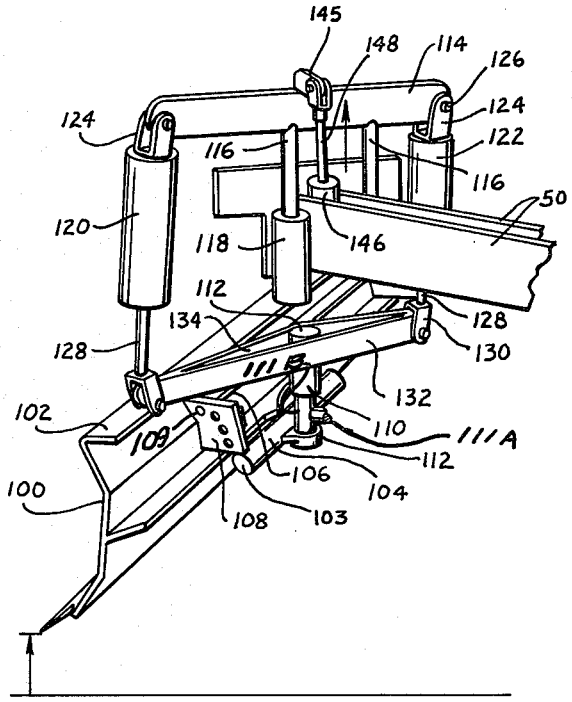
FIG. 4 is a view similar to that in FIG. 3 but with the mold board raised without disturbing the original setting.
Figure 5:
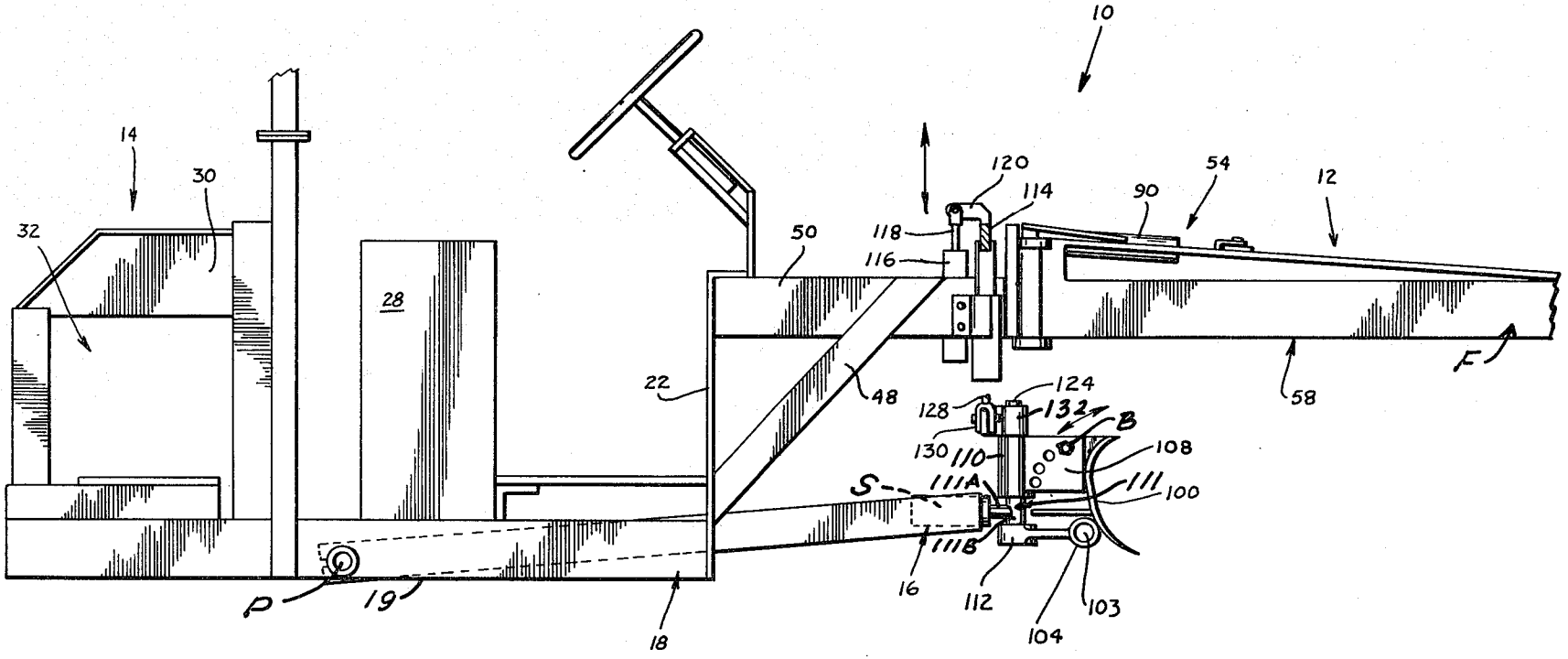
FIG. 5 is a side elevation view of part of the center portion of the frame and chassis of the machine with parts thereof broken away but showing the support of the mold board from the frame.

Member 114 is controlled by means of a hydraulic piston and cylinder arrangement 145 having a cylinder 146 welded to the frame 50 and a piston rod 148 attached by a clevis pin device 150 and joint J to the member 114. Thus the entire mold board assembly 100 including the hydraulic cylinders 120, 122 may be raised or lowered at any time selectively by the operator 24 operating the hand control devices 38 and valves 40, as shown in FIGS. 3 and 4. The prior setting of the board 102 is not disturbed and the board 102 is returned to the preset position of FIG. 3 after raising to the position of FIG. 4. Accordingly, the board 102 may be set and the setting will be undisturbed if the entire assembly including frame 16 is raised and pivoted about pivot P and then lowered either to original height or to a different height if preferred or necessary to clear an obstruction, change grade or the like.

While I have shown and described a particular embodiment of my invention together with a suggested mode of operation and construction thereof this is by way of illustration only and does not constitute the only form of the invention since various alterations, changes, deviations, eliminations, changes, amendments and revisions may be made in the embodiment shown without departing from the scope of this invention as defined only by a proper interpretation of the appended claims.

What is claimed:

1. In a grader machine having a wheel supported machine frame, steering means for steering the machine, power means for driving the machine, a mold board supported and mounted for movement on and extending substantially transversely of said frame, and adjusting and support means for supporting and setting the transverse angle and relative vertical angle and height of said mold board to adjust the height of respective mold board ends with respect to the ground, the improvement comprising: said adjusting and support means comprising independent first and second generally vertically oriented power means extensible and retractable for adjusting and setting the relative vertical angle and height of said mold board, means for simultaneously raising and lowering both of said first and second extensible and retractable power means and said mold board therewith while maintaining the vertical and transverse angle setting thereof and without disturbing the setting of said first and second power means whereby said mold board may be set and thereafter raised and lowered above ground without disturbing the vertical and transverse angle setting and therefore without resetting said mold board each time it is raised, said raising and lowering means simultaneously raising and lowering said mold board and the said first and second extensible and retractable power means approximately straight up and down above the ground whereby the angular relationship of the mold board ends is not affected, said raising and lowering means comprising third generally vertically oriented power means.

2. The machine in claim 1 wherein: said means for raising and lowering includes a support means for supporting said mold board.

3. The device in claim 2 wherein said support means comprises a hydraulic piston and cylinder for raising and lowering said mold board.

4. The machine in claim 1 wherein said mold board is supported by a member attached thereto, said first and second power means comprises first and second hydraulic cylinders for controlling and setting the angle of said board transversely of said machine frame.

5. In a grader machine which has an elongated grader machine frame: a mold board having opposed ends, means supporting said mold board with the ends beneath and on opposite sides of said frame in set position for grading the surface of the ground, adjusting and support means for adjusting and setting the height of the respective mold board ends and the vertical angularity of said mold board on said machine to change the height and/or transverse angularity of the board with respect to the ground and to set same, said adjusting and support means comprising independent first and second generally vertically oriented power means extensible and retractable for adjusting and setting the relative vertical angle and height of said mold board, other means associated with said first and second power means for simultaneously raising and lowering both of said first and second power means to lift said mold board above ground without disturbing the setting thereof and to return same to original or other position with the mold board still in original setting, said other means for raising and lowering being operable to simultaneously raise or lower said mold board and said first and second power means approximately straight up and down above the ground whereby the angular relationship of the mold board ends and the setting of said first and second power means is not affected by raising and lowering same above ground, said other means comprising third generally vertically oriented power means.

6. The mold board in claim 5 including: fourth power means for changing the angularity of said board from one end to the other by pivoting same about a vertical axis beneath said frame, said first and second power means raising or lowering one end of said board with respect to the other end thereof to change the transverse angularity of the board with respect to the ground.

7. The device in claim 6 including: a pivoted support frame on said grader machine frame supporting said mold board, and said other frame raising and lowering said support frame without disturbing the settings of said mold board.

8. The device in claim 7 wherein said mold board has a first member and second attached thereto and extending outwardly therefrom, said first power means comprising respective first and second hydraulic cylinders near the ends of said first member and each cylinder having a piston attached to said first member to set the angularity of the board, said other means comprising a second member supported on said machine frame and having said first and second hydraulic cylinders attached thereto, and said third power means comprising a third hydraulic cylinder attached to said second member for raising or lowering said mold board and the first and second members.

9. The device in claim 8 wherein: there is a means on said machine frame for guiding the movement of said second member.

10. In the machine of claim 7:

said other means comprising a connector attached to said frame and to said mold board wheeby said board will tilt to place one end higher or lower than the other.

11. The device in claim 10 wherein said connector is a T connector and there is a sleeve attached to said mold board and one portion of said T connector being connected for movement therein, a pivot bearing attached to said mold board and having another part of said T connector connected thereto, a first transverse support member attached to said mold board, said first and second power means comprising a pair of hydraulic cylinders respectively attached near opposite ends of said first member, a mold board assembly support member attached respectively to the pair of hydraulic cylinders, a mold board control cylinder mounted on said frame and having a cylinder rod therein attached to said transverse support member.

12. The device in claim 10 including: guide sleeves attached to said frame, and guide members attached to said transverse support member and being mounted for movement in said guide sleeves, whereby said mold board may be set as to angularity and the distance from the ground and the entire mold board assembly may be raised and lowered and returned to original position without disturbing the setting.

* * * * *